US010116098B2

(12) United States Patent
Zhao

(10) Patent No.: US 10,116,098 B2
(45) Date of Patent: Oct. 30, 2018

(54) ELECTRICAL CONNECTOR HAVING A SHIELDING SHELL AND A METALLIC FRAME EXTENDING REARWARD BEYOND THE SHIELDING SHELL TO SHIELD EXPOSED CONTACT TAILS

(71) Applicant: FOXCONN INTERCONNECT TECHNOLOGY LIMITED, Grand Cayman (KY)

(72) Inventor: Jun Zhao, Huaian (CN)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 15/860,635

(22) Filed: Jan. 2, 2018

(65) Prior Publication Data

US 2018/0191103 A1 Jul. 5, 2018

(30) Foreign Application Priority Data

Dec. 30, 2016 (CN) ..... 2016 1 1260128

(51) Int. Cl.
*H01R 13/6587* (2011.01)
*H01R 13/6585* (2011.01)
(Continued)

(52) U.S. Cl.
CPC ..... *H01R 13/6585* (2013.01); *H01R 12/716* (2013.01); *H01R 13/6594* (2013.01); *H01R 24/60* (2013.01)

(58) Field of Classification Search
CPC ..... H01R 13/6585; H01R 13/6594; H01R 13/6587; H01R 13/5202; H01R 13/5208;
(Continued)

(56) References Cited

U.S. PATENT DOCUMENTS 7,758,379 B2 * 7/2010 Chen ..... H01R 13/6485 439/607.11
8,851,927 B2 * 10/2014 Hsu ..... H01R 12/724 439/607.11
(Continued)

FOREIGN PATENT DOCUMENTS

| | | |
|---|---|---|
| CN | 204304072 | 4/2015 |
| CN | 204696302 | 10/2015 |
| CN | 204835065 | 12/2015 |

*Primary Examiner* — Harshad C Patel
(74) *Attorney, Agent, or Firm* — Wei Te Chung; Ming Chieh Chang

(57) ABSTRACT

An electrical connector includes: a metallic frame having a main part, a board at a rear of the main part, and an upper shield behind the board; an upper and lower contact modules arranged at two opposite sides of the metallic frame main part, each contact module having a row of contacts, each contact having a contacting portion, an intermediate portion, and a tail; an insulative housing having a base and a tongue; a shielding shell accommodating the board of the metallic frame and enclosing the insulative housing, the contact tails of at least one of the upper and lower contact modules extending rearward beyond a rear end of the shielding shell; wherein the upper shield of the metallic frame shields the contact tails of the at least one contact module.

15 Claims, 17 Drawing Sheets

(51) Int. Cl.
*H01R 12/71* (2011.01)
*H01R 24/60* (2011.01)
*H01R 13/6594* (2011.01)

(58) Field of Classification Search
CPC . H01R 13/5219; H01R 13/6582; H01R 24/60
USPC ..... 439/607.05, 607.51, 607.57, 607.58, 439/607.13, 607.2, 607.23, 607.32
See application file for complete search history.

(56) References Cited

U.S. PATENT DOCUMENTS

| | | | | |
|---|---|---|---|---|
| 9,525,227 | B2 | 12/2016 | Little et al. | |
| 9,525,244 | B1 * | 12/2016 | Hsu | H01R 13/6585 |
| 2014/0194005 | A1 * | 7/2014 | Little | H01R 13/6585 439/607.28 |
| 2015/0244111 | A1 * | 8/2015 | Ju | H01R 13/6585 439/607.05 |
| 2015/0244118 | A1 * | 8/2015 | Lin | H01R 24/60 439/357 |
| 2015/0295362 | A1 | 10/2015 | Tziviskos et al. | |
| 2015/0311636 | A1 * | 10/2015 | Chang | H01R 13/6471 439/607.28 |
| 2016/0197443 | A1 * | 7/2016 | Zhang | H01R 13/6585 439/607.05 |
| 2016/0233630 | A1 * | 8/2016 | Cheng | H01R 24/60 |

* cited by examiner

ELECTRICAL CONNECTOR HAVING A SHIELDING SHELL AND A METALLIC FRAME EXTENDING REARWARD BEYOND THE SHIELDING SHELL TO SHIELD EXPOSED CONTACT TAILS

BACKGROUND OF THE INVENTION

1. Field of the Invention

The present invention relates to an electrical connector having a metallic frame and a row of contact tails extending rearward beyond a shielding shell but shielded by the metallic frame.

2. Description of Related Arts

U.S. Patent Application Publication No. 2015/0295362, published on Oct. 15, 2015, discloses a connector receptacle tongue including a metallic piece. Metallic piece may include side portions having cutouts. Side portions may be braced with one or more cross braces. A contact module may be aligned with slots or grooves on inner sides of the side portions and slid into the metallic piece. The metallic piece may further include a rear extension that may include tabs for inserting in an opening and soldering to a trace at the opening on a printed circuit board.

SUMMARY OF THE INVENTION

An electrical connector comprises: a metallic frame having a main part, a board at a rear of the main part, and an upper shield behind the board; an upper and lower contact modules arranged at two opposite sides of the metallic frame main part, each contact module having a row of contacts, each contact having a contacting portion, an intermediate portion, and a tail; an insulator molded to the metallic frame and the contact modules to complete an insulative housing, the insulative housing having a base and a tongue, the tongue exposing respective contacting portions of the upper and lower contact modules to two opposite surfaces thereof; a shielding shell accommodating the board of the metallic frame and enclosing the insulative housing, the contact tails of at least one of the upper and lower contact modules extending rearward beyond a rear end of the shielding shell; wherein the upper shield of the metallic frame shields the contact tails of the at least one contact module.

DETAILED DESCRIPTION OF THE PREFERRED EMBODIMENTS

Figure 1:
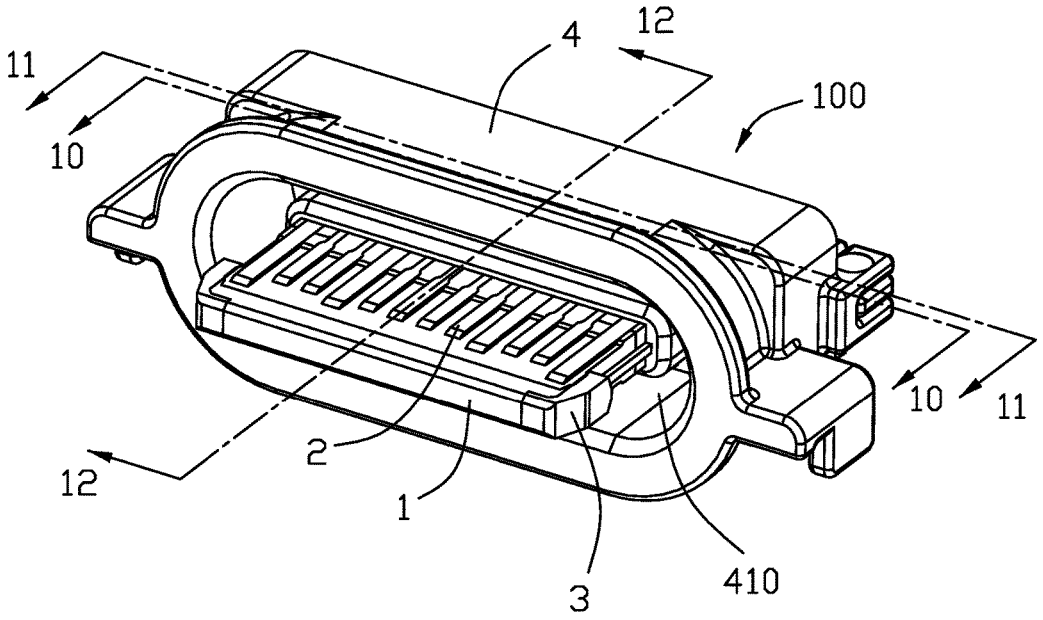
FIG. 1 is a front perspective view of an electrical connector in accordance with a first embodiment of the present invention.
Figure 2:
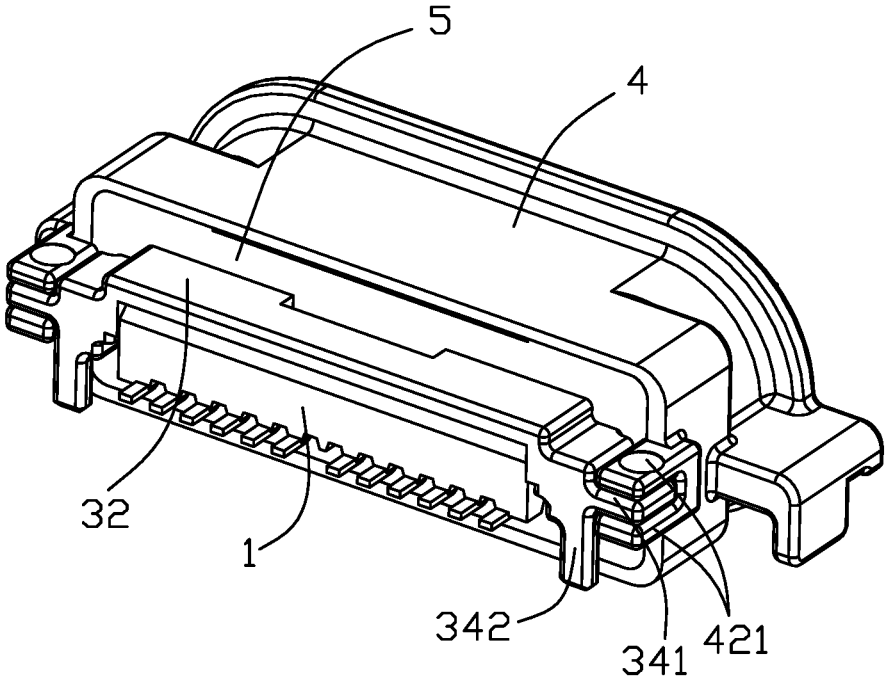
FIG. 2 is a rear perspective view of the electrical connector.
Figure 3:
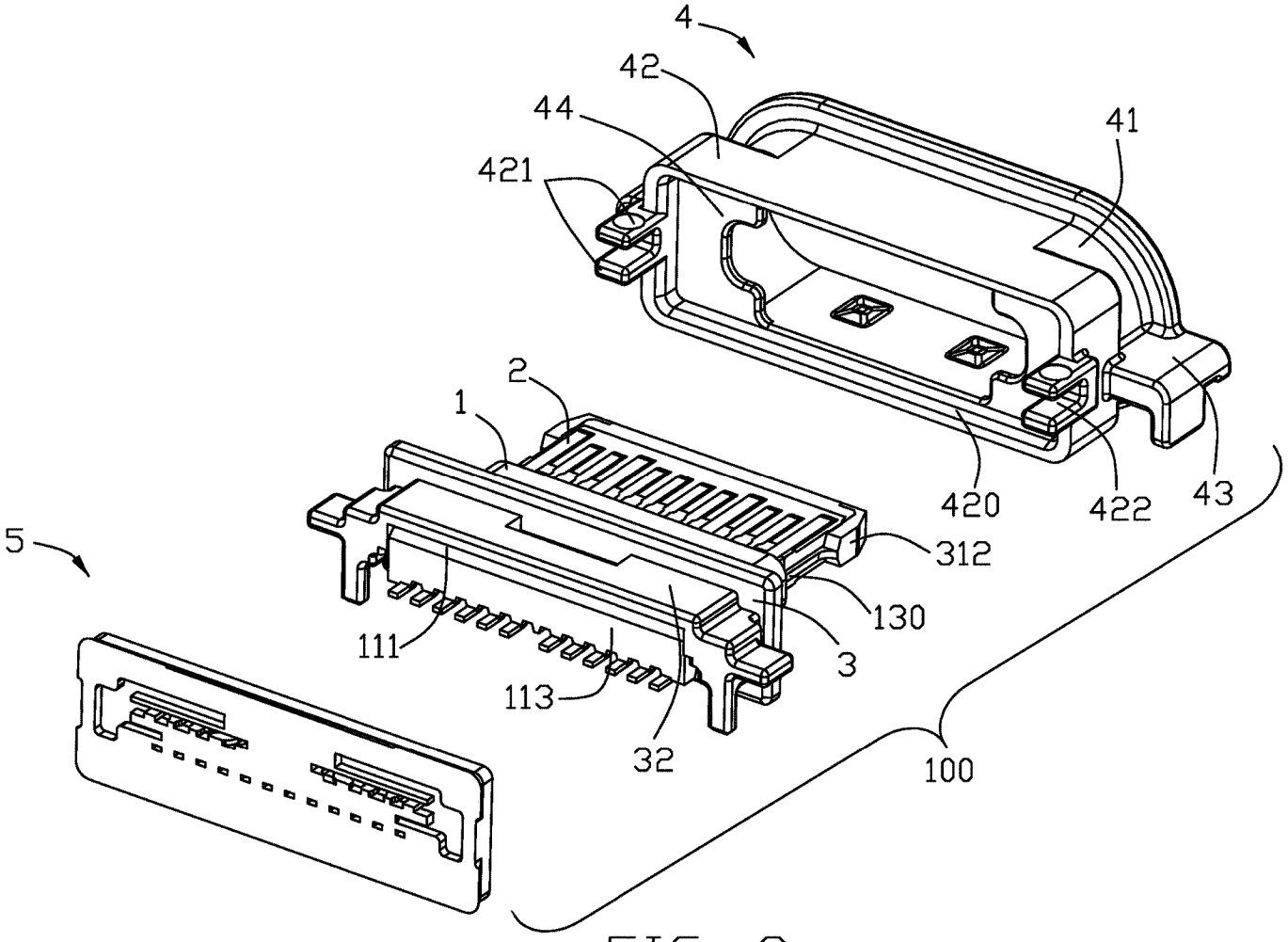
FIG. 3 is an exploded view of the electrical connector.

Referring to FIGS. 1-12, an electrical connector 100 of a first embodiment comprises a metallic frame 3, an upper and lower contact modules mounted to the metallic frame 3, an insulator 13 molded to the metallic frame 3 and the two contact modules to complete an insulative housing 1, and a shielding shell 4 enclosing the metallic frame 3 and the two contact modules. The electrical connector 100 may further include a rear sealing element 5.

Referring specifically to FIGS. 4-9, in construction, the insulative housing 1 includes an upper insulator 11, a lower insulator 12, and an insulator 13 over-molding the metallic frame 3 and the two insulators 11 and 12. The upper insulator 11 has a base portion 111 and a tongue portion 112. The base portion 111 has a rear stand 113 and a step 114. Similarly, the tongue portion 112 has an opening 115 and a pair of notches 116. The lower insulator 12 has a base portion 121 and a tongue portion 122. The base portion 121 has a rear stand 123 and a step 124. The tongue portion 122 has an opening 125 and a pair of notches 126. The insulator 13 fills up gaps between assembled upper and lower insulators 11 and 12. The base portions 111 and 121 constitute an overall base of the insulative housing 1. The tongue portions 112 and 122 and the insulator 13 constitute an overall tongue of the insulative housing 1. The rear stands 113 and 123 constitute an overall stand and extend rearward beyond the shielding shell 4.

The upper insulator 11 is molded with a row of upper contacts 21 and the lower insulator 12 is molded with a row of lower contacts 22. Each upper contact 21 has a contacting portion 211 exposed to an upper surface of the tongue portion 112, a tail 213, and an intermediate portion 212. Each lower contact 22 has a contacting portion 221 exposed to a lower surface of the tongue portion 122, a tail 223, and an intermediate portion 222. The upper contacts 21 and the lower contacts 22 are symmetrically arranged, having a common reference numeral 2.

Each row of contacts 21 or 22 include two outermost ground contacts 23, two pairs of high-speed differential signal contacts respectively next to the two ground contacts, two power contacts respectively next to neighboring high-speed differential signal pair, a pair of low-speed differential signal contacts in the middle, and two control signals beside the low-speed differential signal pair. The ground contact 23 is exposed to the notch 116 or 126. The ground contact 23 in the upper row has an engaging bend 214 at the intermediate portion 212 thereof; the ground contact 23 in the lower row has an engaging bend 224 at the intermediate portion 222 thereof.

Figure 4:
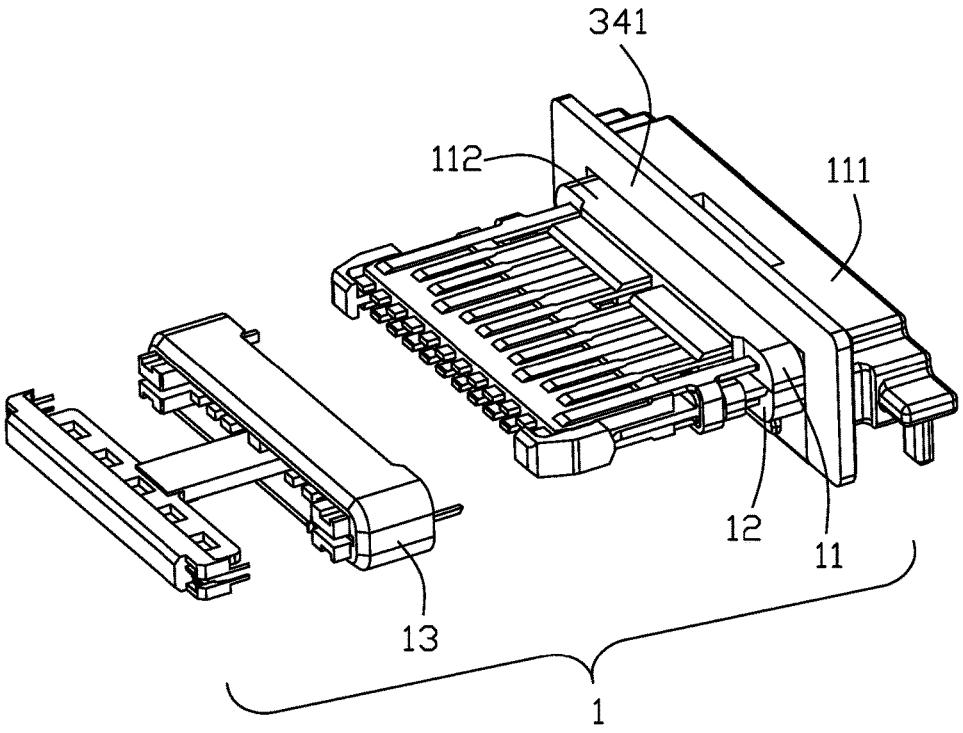
FIG. 4 is an exploded view of a part of the electrical connector.
Figure 5:
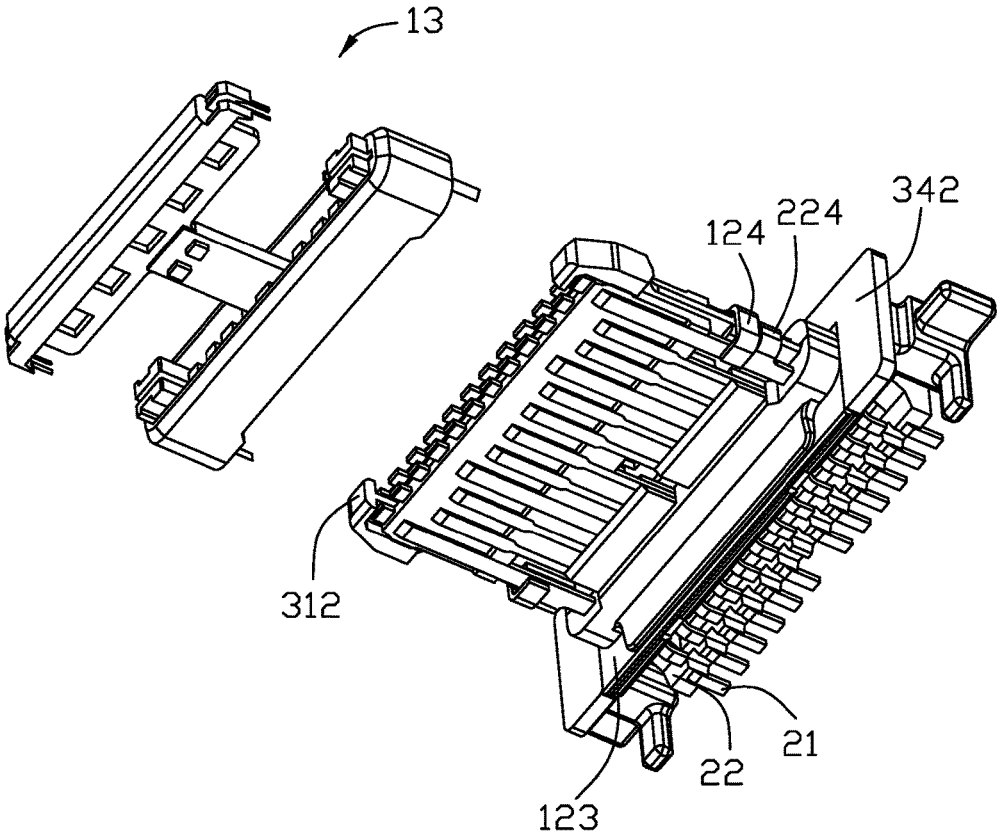
FIG. 5 is a view similar to FIG. 4 but from a different perspective.
Figure 6:
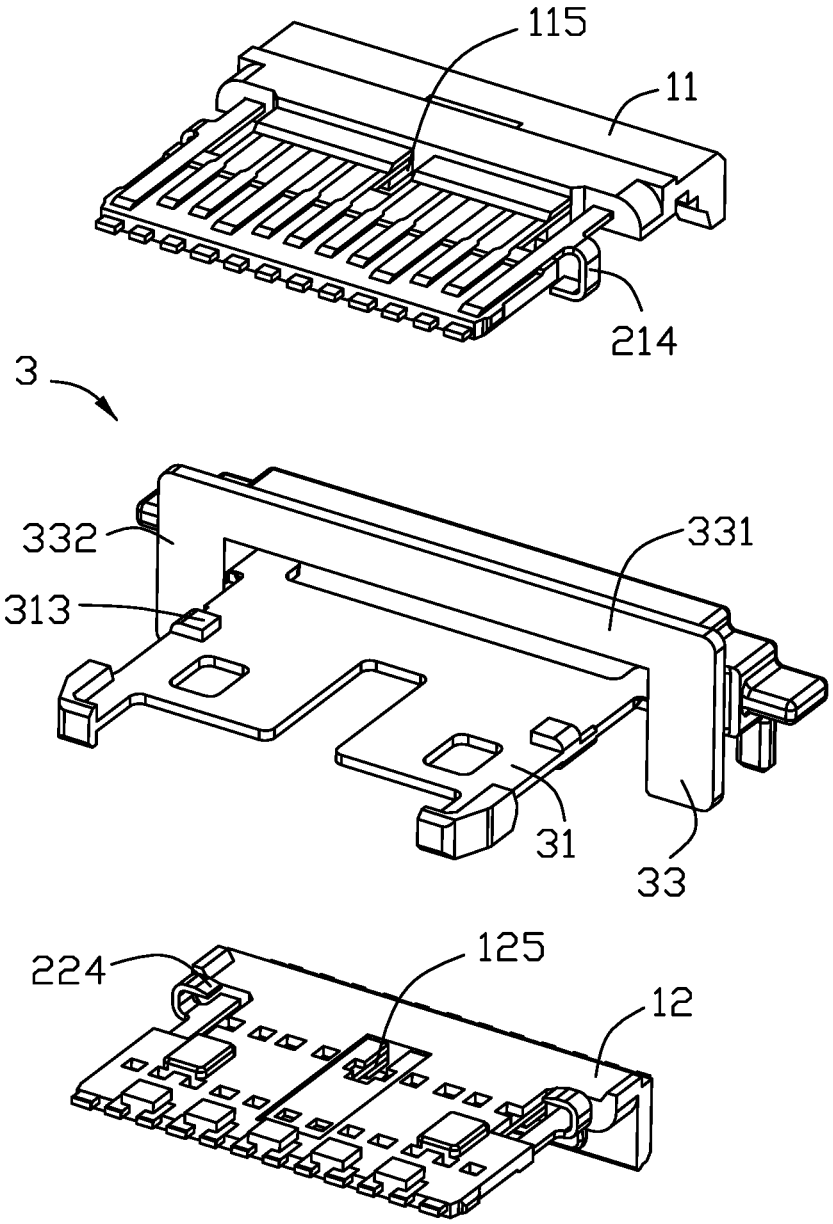
FIG. 6 is a further exploded view of FIG. 4.
Figure 7:
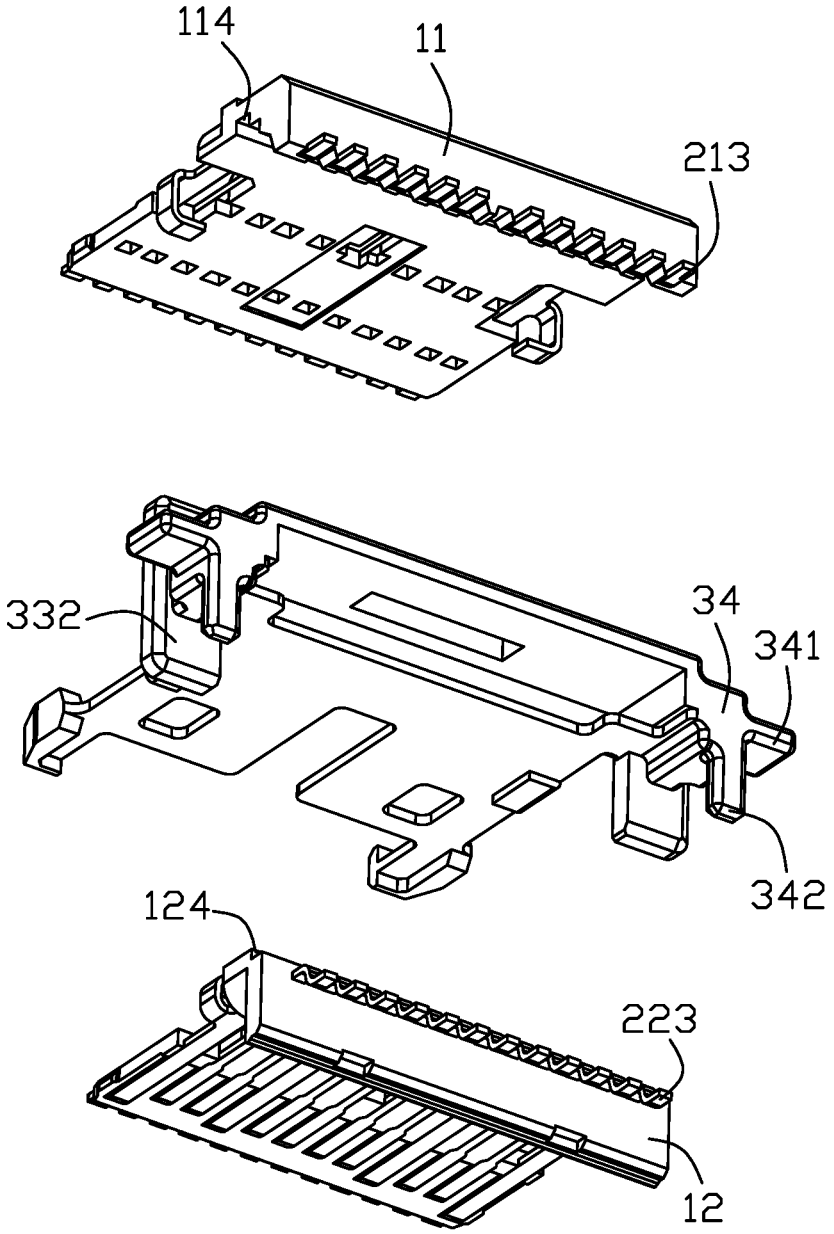
FIG. 7 is a view similar to FIG. 6 but from a different perspective.
Figure 8:
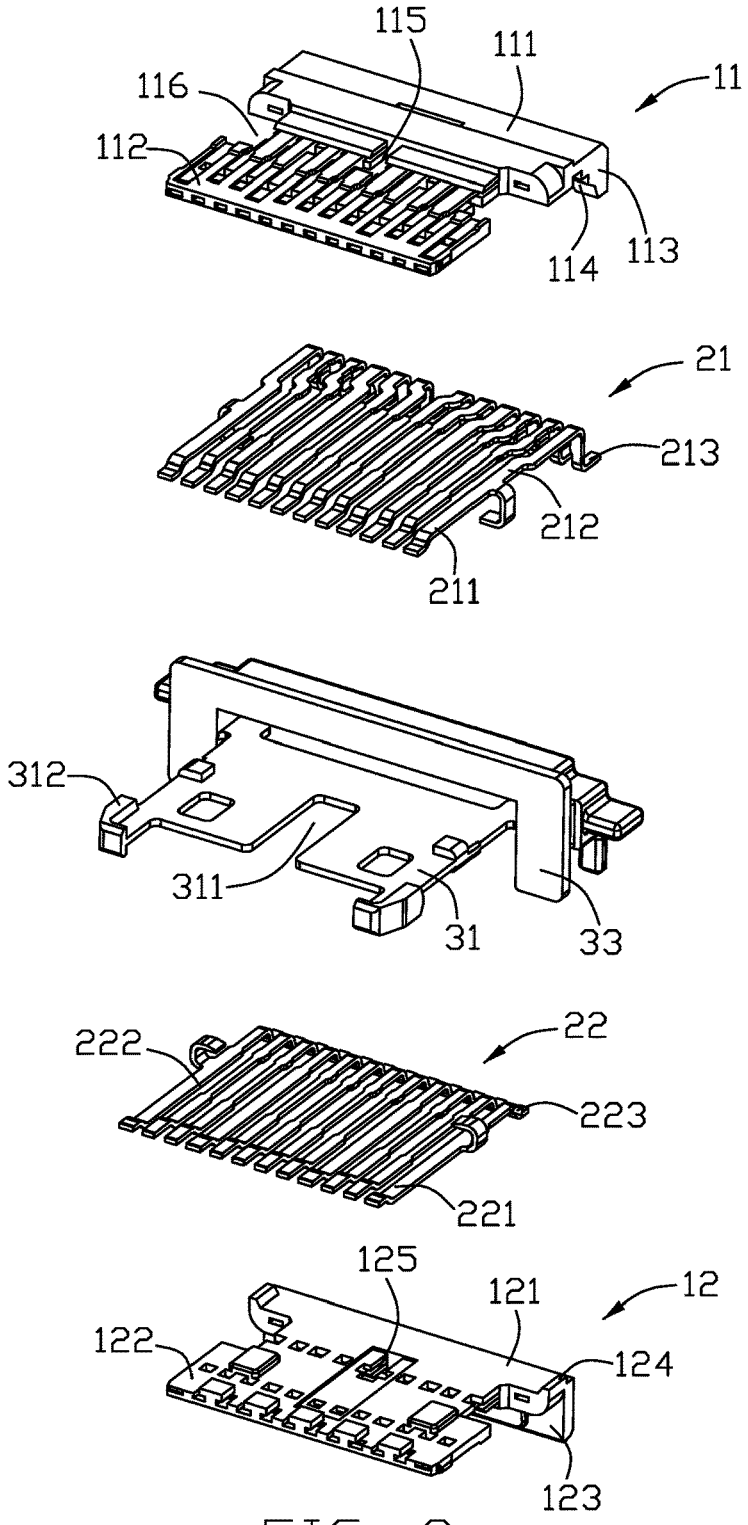
FIG. 8 is a further exploded view of FIG. 6.
Figure 9:
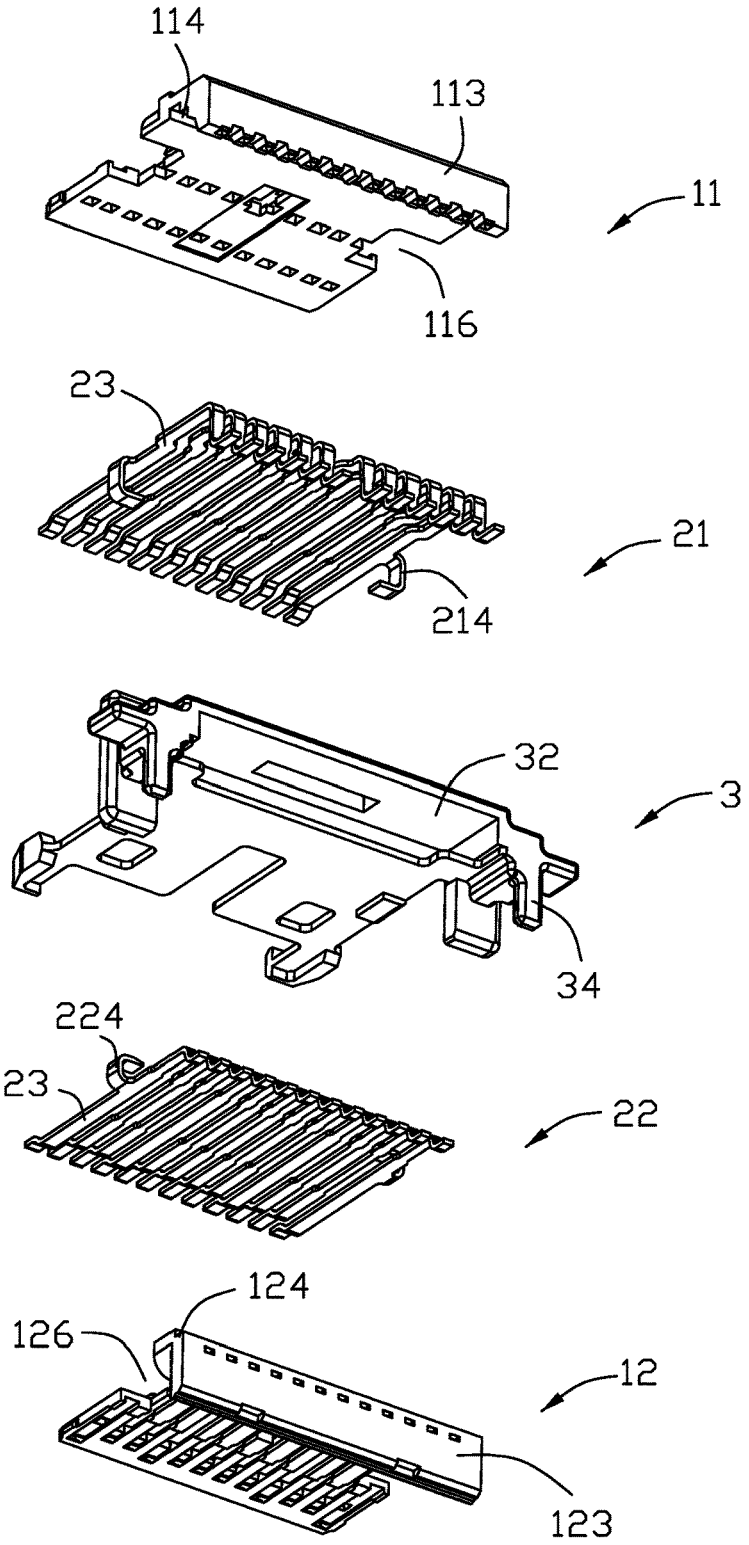
FIG. 9 is a view similar to FIG. 8 but from a different perspective.
Figure 10:
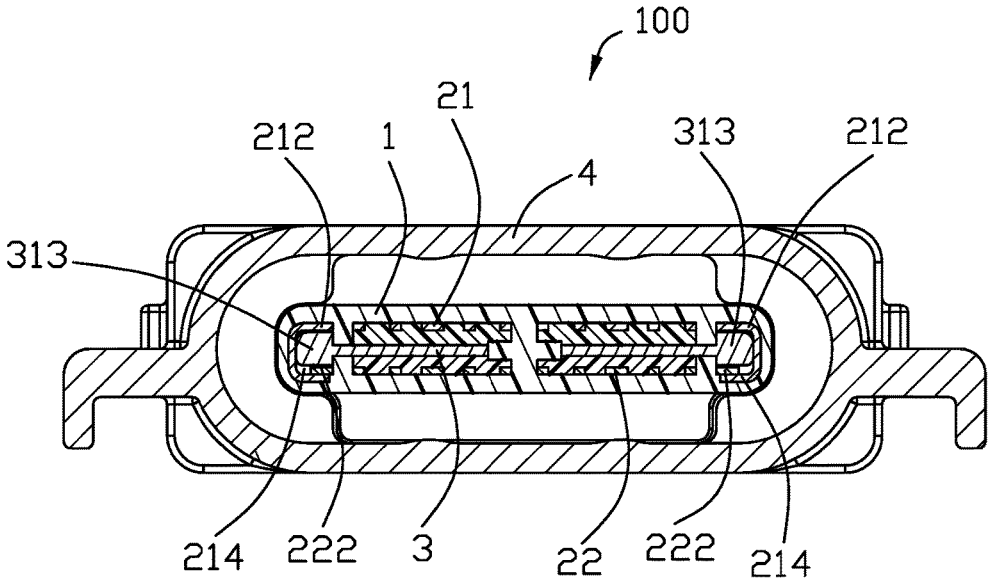
FIG. 10 is a cross-sectional view of the electrical connector taken along line A-A in FIG. 1.
Figure 11:
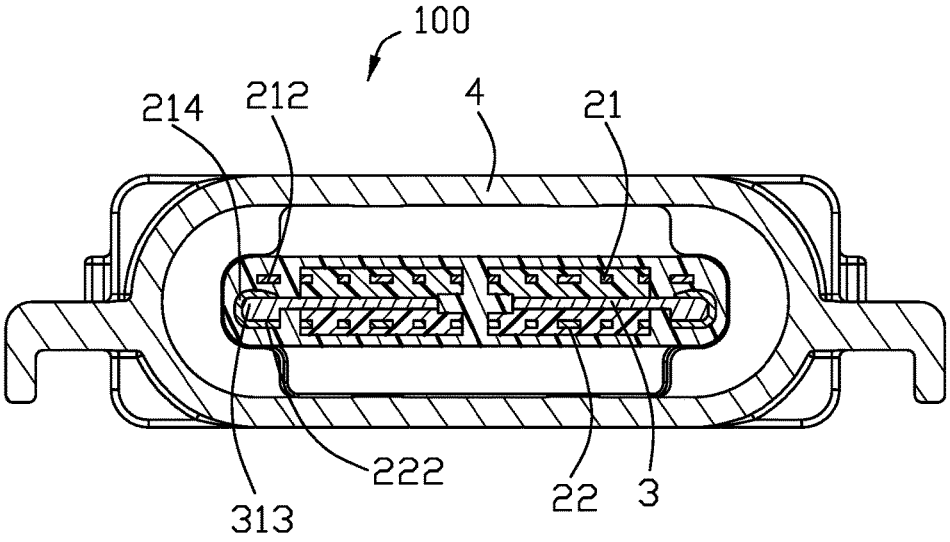
FIG. 11 is a cross-sectional view of the electrical connector taken along line B-B in FIG. 1.
Figure 12:
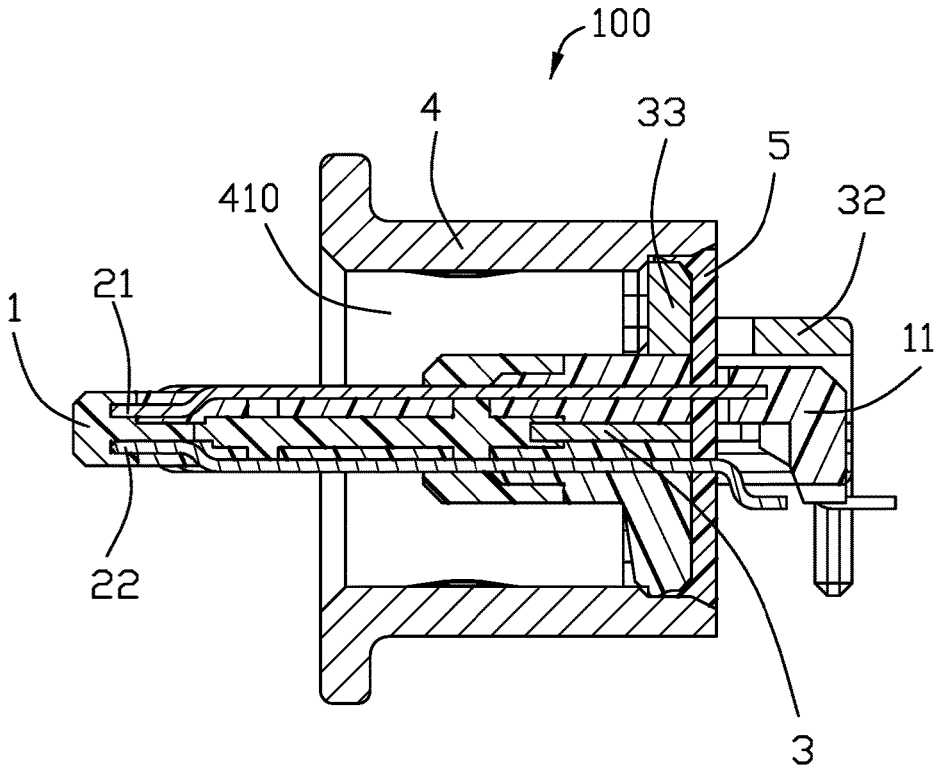
FIG. 12 is a cross-sectional view of the electrical connector taken along line C-C in FIG. 1.
Figure 13:
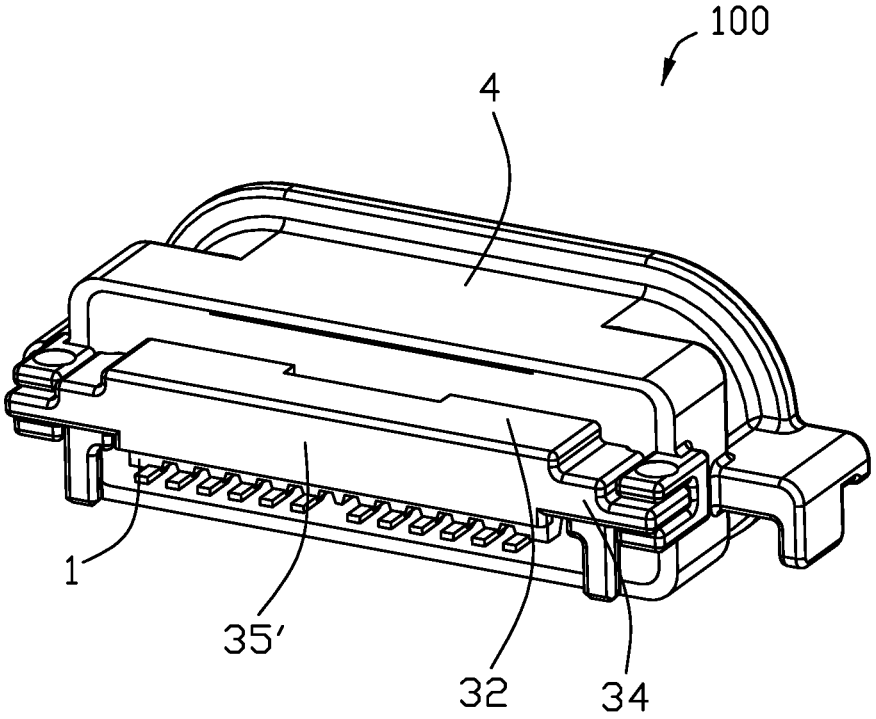
FIG. 13 is a rear perspective view of an electrical connector in accordance with a second embodiment of the present invention.
Figure 14:
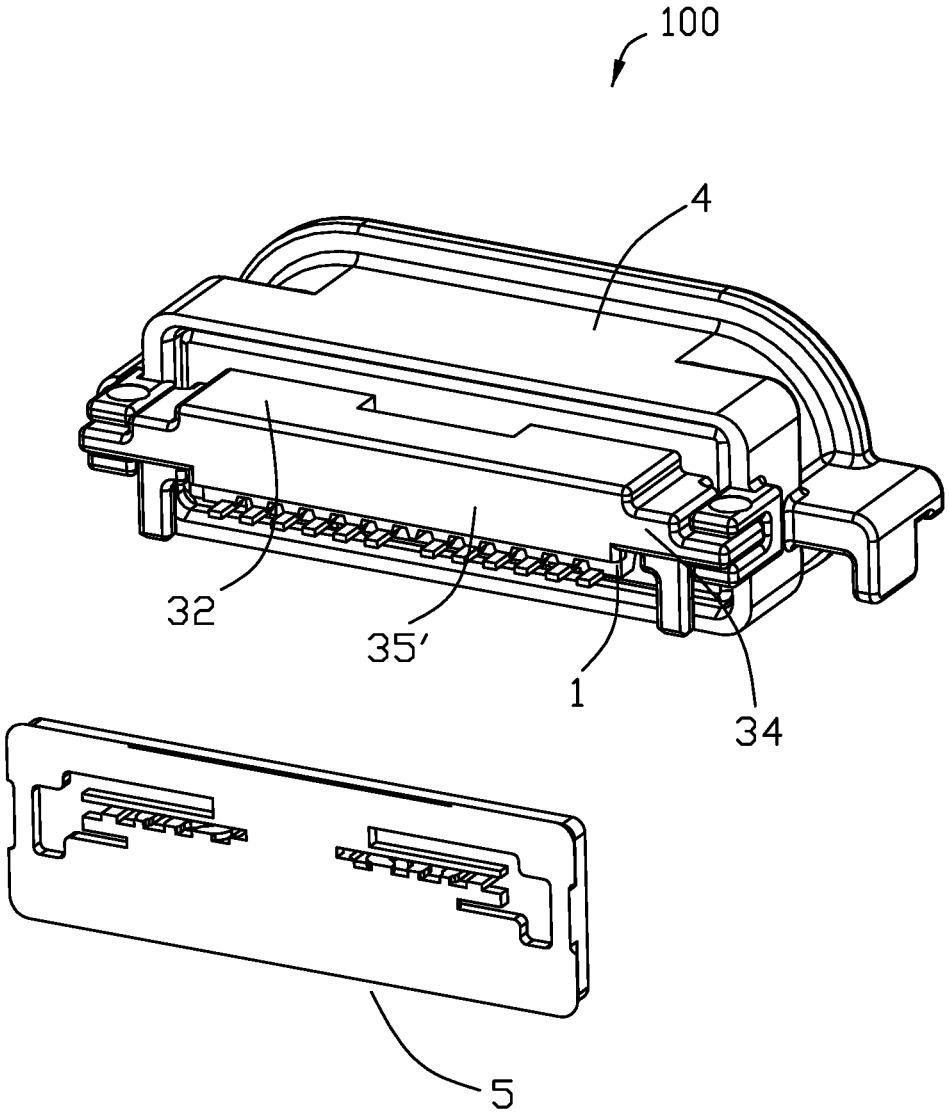
FIG. 14 is a view similar to FIG. 13, showing a sealing element thereof separately.
Figure 15:
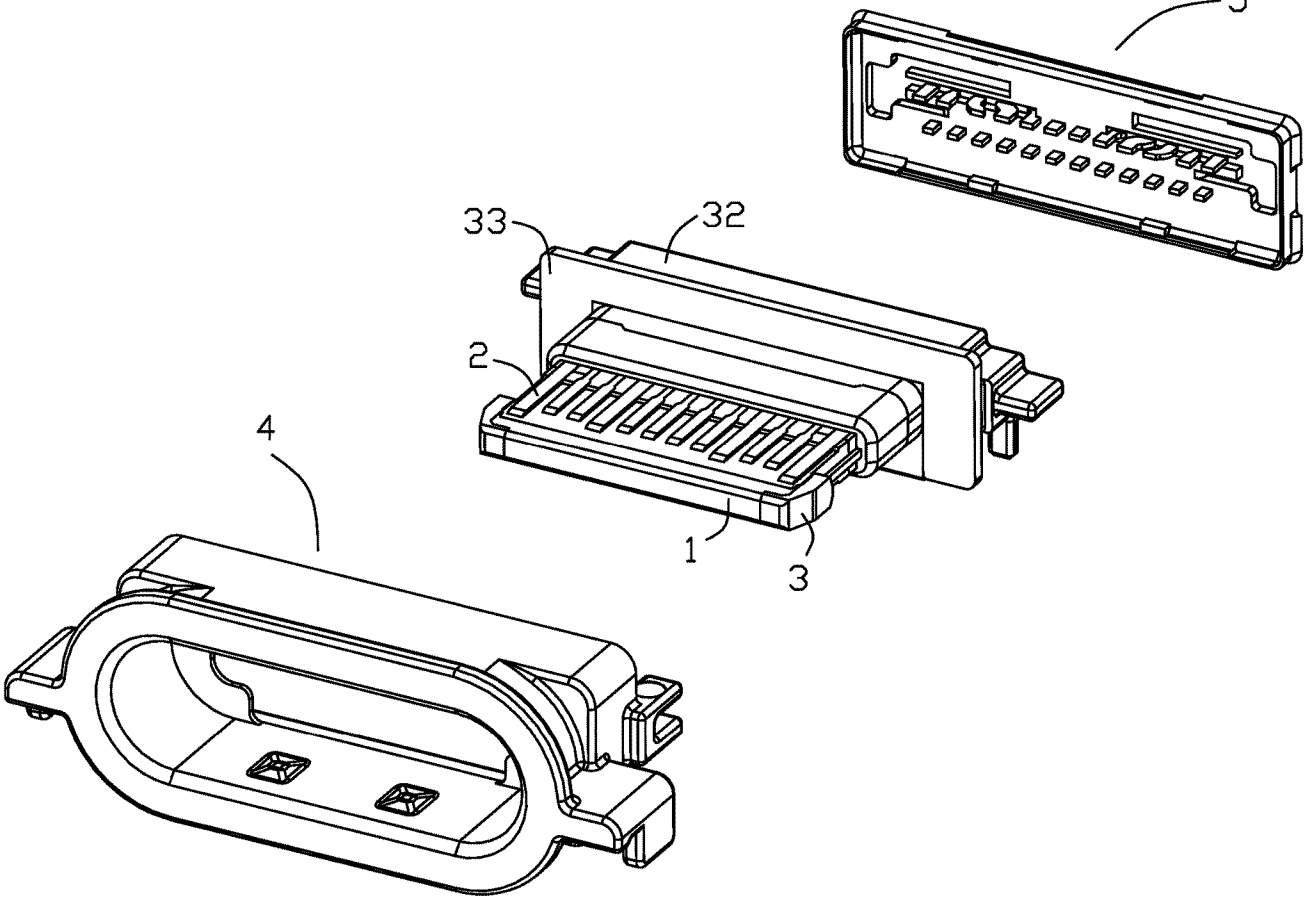
FIG. 15 is a front exploded view of the electrical connector in FIG. 13.
Figure 16:
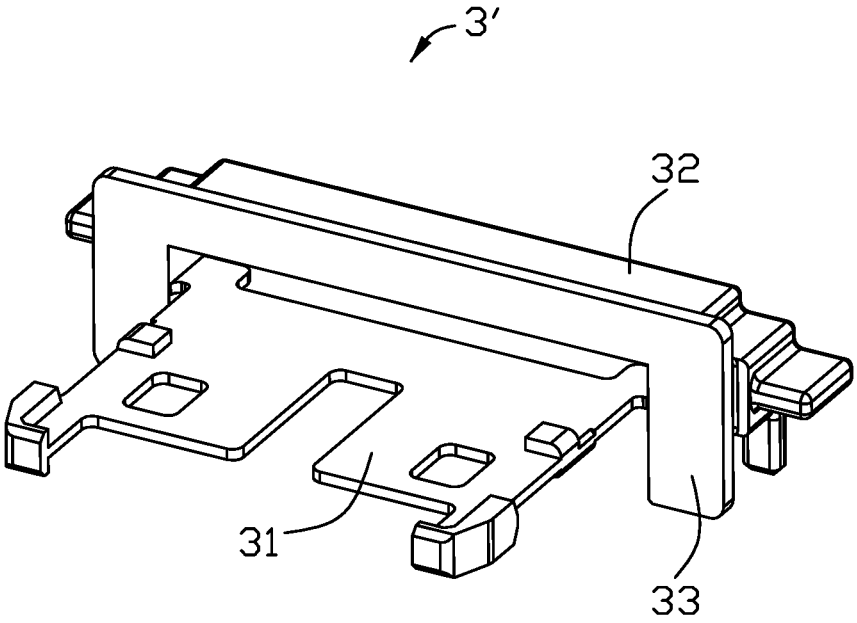
FIG. 16 shows a front perspective view of a metallic frame of the electrical connector in FIG. 13.
Figure 17:
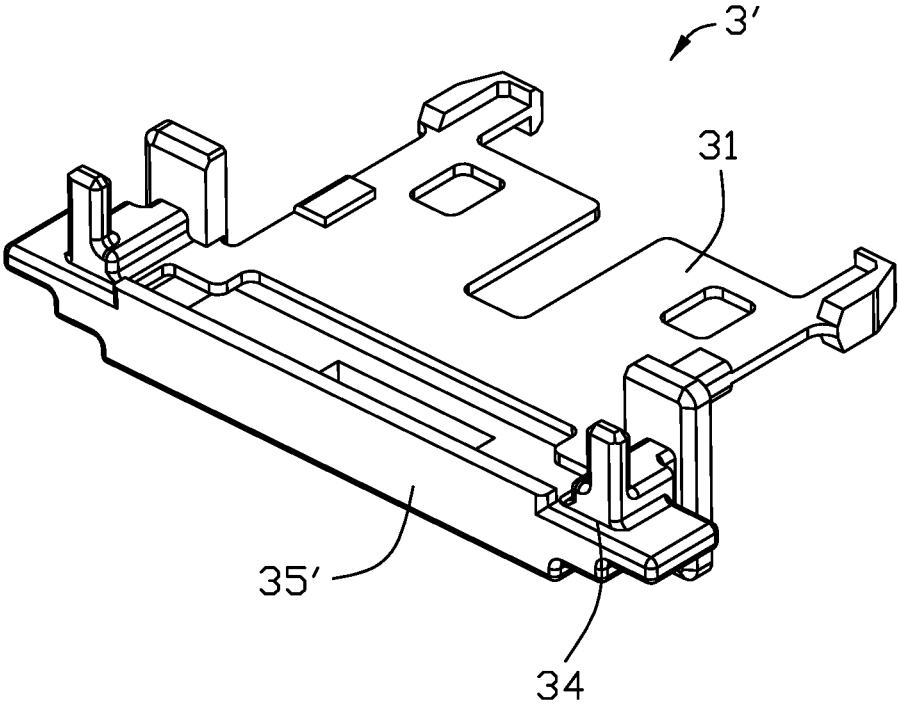
FIG. 17 is a view similar to FIG. 16 but from a different perspective.

Referring specifically to FIGS. 1-9, the metal frame 3 is located between the upper insulator 11 and the lower insulator 12. The metal frame 3 has a main part 31, a board 33 at a rear of the main part 31, an upper shield 32 behind the board 33, and a pair of cross-shaped mounting parts 34 at two opposite ends of a rear of the board 33. The main part 31 has a notch 311 corresponding to the notches 116 and 126, a pair of corners 312, a respective pair of blocks 313 at two opposite surfaces thereof. As shown in FIGS. 4, 5, and 10, a bottom surface of the intermediate portion 212 of the ground contact 23 in the upper row is in contact with the block 313 of the main part 31 at the upper surface, and the engaging bend 214 of the ground contact 23 in the upper row is in contact with the ground contact 23 in the lower row, in order to have a better grounding effect. Similarly, as shown in FIGS. 4, 5, and 11, a top surface of the intermediate portion 222 of the ground contact 23 in the lower row is in contact with the block 313 of the main part 31 at the lower surface, and the engaging bend 224 of the ground contact 23 in the lower row is in contact with the ground contact 23 in the upper row, in order to have a better grounding effect. The engaging bends 214 and 224 of the ground contacts 23 further contact two sides of the main part 31. The board 33 lies in a vertical plane and includes a horizontal part 331 and two vertical parts 332. Each mounting part 34 also includes a horizontal part 341 and a vertical parts/leg. 342. The board horizontal part 331 crosses over the tongue portion 112, and the two vertical parts 332 are located at and aligned with two sides of the rear stand 123. The upper shield 32 crosses over the base portion 111 and the mounting part 34 is at two sides of the rear stand 113.

The shielding shell 4 includes a first tubular part 41, a second tubular part 42, and a pair of wings 43. The first tubular part 41 has a receiving space 410 and the second tubular part 42 has a receiving space 420. At the junction of the first part 41 and the second part 42 is disposed a protruding wall 44. The protruding wall 44 has a surrounding wall part profiled to accommodate the tongue of the insulative housing 1. The board 33 of the metal frame 3 abuts the protruding wall 44. The second tubular part 42 has a respective pair of rear receptacles 421 each having a slot 422 for receiving the horizontal part 341. Notably, both the shielding shell 4 and the frame 3 are made via metal injection molding with a relatively strong stiffness thereof, compared with the stamping/bending/forming type metal pieces. In other words, the unitary structure of either the frame 3 or the shielding shell 4 may provide superior strength for enduring operational mating faces imposed upon the connector.

FIGS. 13-17 show an electrical connector 100' of a second embodiment which is sensually same as the electrical connectors 100 except for metallic frame 3'. The metallic frame 3' further includes a rear shield 35' extending downward from a rear of the upper shield 32 and the rear shield 35' connects at two sides thereof with the mounting part 34 to form a shielding space accommodating the stand of the insulative housing 1.

What is claimed is:

1. An electrical connector comprising:

a metallic frame having a main part, a board at a rear of the main part, and an upper shield behind the board;

an upper and lower contact modules arranged at two opposite sides of the metallic frame main part, each contact module having a row of contacts, each contact having a contacting portion, an intermediate portion, and a tail;

an insulator molded to the metallic frame and the contact modules to complete an insulative housing, the insulative housing having a base and a tongue, the tongue exposing respective contacting portions of the upper and lower contact modules to two opposite surfaces thereof;

a shielding shell accommodating the board of the metallic frame and enclosing the insulative housing, the contact tails of at least one of the upper and lower contact modules extending rearward beyond a rear end of the shielding shell; wherein the upper shield of the metallic frame shields the contact tails of the at least one contact module.

2. The electrical connector as claimed in claim 1, wherein the metallic frame includes a rear shield extending downward from a rear of the upper shield.

3. An electrical connector comprising:

a metallic frame made by metal injection molding and having a horizontal main part, a vertical board at a rear of the main part, and an upper shield located behind the board in a front-to-back direction, and extending in a transverse direction perpendicular to said front-to-back direction;

upper and lower rows of contacts, each contact having a contacting portion, an intermediate portion, and a tail, the contacting portions of the upper row of contacts and those of the lower row of contacts respectively located on opposite sides of the main part in a vertical direction perpendicular to both said front-to-back direction and said transverse direction;

an insulative housing integrally formed with the upper row of contacts, the lower rows of contacts and the metallic frame, the insulative housing having a base and a tongue, the tongue exposing respective contacting portions of the upper and lower contact modules upon two opposite surfaces thereof;

a shielding shell made by metal injection molding and accommodating the board of the metallic frame and enclosing the insulative housing, the contact tails of at least either the upper row of contacts or the lower row of contacts extending rearward beyond a rear end of the shielding shell; wherein the upper shield of the metallic frame shields the contact tails of the at least either the upper row of contacts or the lower row of contacts in the vertical direction, and wherein the upper row of contacts has a pair of grounding contacts at two opposite lateral sides in the transverse direction, and each of said grounding contacts includes an engaging bend extending from the intermediate portion in the transverse direction for pressing the main part of the frame.

4. The electrical connector as claimed in claim 3, wherein the metallic frame includes a pair of mounting parts at two opposite ends of the upper shield in the transverse direction for mounting to a printed circuit board.

5. The electrical connector as claimed in claim 4, wherein said upper shield covers the base in the vertical direction.

6. The electrical connector as claimed in claim 3, wherein each of said mounting parts includes a horizontal part engaged with the shielding shell, and a vertical part for mounting to the printed circuit board.

7. The electrical connector as claimed in claim 3, wherein the upper row of contacts are integrally formed within an upper insulator to commonly form an upper contact module, and said upper contact module is forwardly assembled to said metallic frame along said front-to-back direction and restrained between the horizontal main part and the vertical board in said vertical direction.

8. The electrical connector as claimed in claim 3, wherein the lower row of contacts are integrally formed within a lower insulator to commonly form a lower contact module, and said lower insulator is aligned with and located under the vertical board.

9. An electrical connector comprising:

a metallic frame made by metal injection molding and having a horizontal main part, a vertical board at a rear of the main part, and an upper shield located behind the board in a front-to-back direction, and extending in a transverse direction perpendicular to said front-to-back direction;

upper and lower rows of contacts, each contact having a contacting portion, an intermediate portion, and a tail, the contacting portions of the upper row of contacts and those of the lower row of contacts respectively located on opposite sides of the main part in a vertical direction perpendicular to both said front-to-back direction and said transverse direction;

an insulative housing integrally formed with the upper row of contacts, the lower rows of contacts and the metallic frame, the insulative housing having a base and a tongue, the tongue exposing respective contacting portions of the upper and lower contact modules upon two opposite surfaces thereof;

a shielding shell made by metal injection molding and accommodating the board of the metallic frame and enclosing the insulative housing, the contact tails of at least either the upper row of contacts or the lower row of contacts extending rearward beyond a rear end of the shielding shell; wherein the upper shield of the metallic frame shields the contact tails of the at least either the upper row of contacts or the lower row of contacts in the vertical direction, and wherein the lower row of contacts has a pair of grounding contacts at two opposite lateral sides in the transverse direction, and each of said grounding contacts includes an engaging bend extending from the intermediate portion in the transverse direction for pressing the main part of the frame.

10. The electrical connector as claimed in claim 9, wherein the metallic frame includes a pair of mounting parts at two opposite ends of the upper shield in the transverse direction for mounting to a printed circuit board.

11. The electrical connector as claimed in claim 10, wherein said upper shield covers the base in the vertical direction.

12. The electrical connector as claimed in claim 9, wherein each of said mounting parts includes a horizontal part engaged with the shielding shell, and a vertical part for mounting to the printed circuit board.

13. The electrical connector as claimed in claim 9, wherein the upper row of contacts are integrally formed within an upper insulator to commonly form an upper contact module, and said upper contact module is forwardly assembled to said metallic frame along said front-to-back direction and restrained between the horizontal main part and the vertical board in said vertical direction.

14. The electrical connector as claimed in claim 9, wherein the lower row of contacts are integrally formed within a lower insulator to commonly form a lower contact module, and said lower insulator is aligned with and located under the vertical board.

15. The electrical connector as claimed in claim 9, wherein the upper row of contacts has a pair of grounding contacts at two opposite lateral sides in the transverse direction, and each of said grounding contacts includes an engaging bend pressing the main part of the frame.

* * * * *